US009097047B2

(12) United States Patent
Adriaansen

(10) Patent No.: US 9,097,047 B2
(45) Date of Patent: Aug. 4, 2015

(54) CANTILEVERED FOLDING GATE AND MODULE SUITABLE FOR FITTING IN SUCH GATE

(76) Inventor: Luc Adriaansen, Sint-Niklaas (BE)

( * ) Notice: Subject to any disclaimer, the term of this patent is extended or adjusted under 35 U.S.C. 154(b) by 0 days.

(21) Appl. No.: 14/005,194

(22) PCT Filed: Mar. 13, 2012

(86) PCT No.: PCT/EP2012/001110
§ 371 (c)(1),
(2), (4) Date: Feb. 19, 2014

(87) PCT Pub. No.: WO2012/123101
PCT Pub. Date: Sep. 20, 2012

(65) Prior Publication Data

US 2014/0150344 A1 Jun. 5, 2014

(30) Foreign Application Priority Data

Mar. 15, 2011 (BE) ..... 2011/0160

(51) Int. Cl.

| | |
|---|---|
| ***E05C 7/06*** | (2006.01) |
| ***E05D 15/10*** | (2006.01) |
| ***E05D 15/26*** | (2006.01) |
| ***E05F 15/605*** | (2015.01) |

(52) U.S. Cl.

CPC ..... *E05D 15/10* (2013.01); *E05D 15/262* (2013.01); *E05F 15/605* (2015.01); *E05Y 2201/604* (2013.01); *E05Y 2201/62* (2013.01); *E05Y 2201/686* (2013.01); *E05Y 2201/722* (2013.01); *E05Y 2800/205* (2013.01); *E05Y 2800/29* (2013.01); *E05Y 2900/402* (2013.01)

(58) Field of Classification Search

CPC ..... E05D 15/10; E05Y 2201/604; E05Y 2201/62; E05Y 2201/686; E05Y 2201/722; E05Y 2800/205; E05Y 2800/29; E05Y 2800/402

USPC ..... 49/138, 95, 96, 100, 101, 104, 106, 49/107, 108, 109, 114

See application file for complete search history.

(56) References Cited

U.S. PATENT DOCUMENTS

| | | | | |
|---|---|---|---|---|
| 1,440,463 | A * | 1/1923 | Heaslip | 49/300 |
| 1,755,788 | A * | 4/1930 | Morse | 49/107 |
| 2,455,018 | A * | 11/1948 | McKeown | 49/102 |
| 2,532,758 | A * | 12/1950 | Carr | 160/188 |
| 2,670,952 | A * | 3/1954 | Bushell | 49/109 |
| 4,442,630 | A * | 4/1984 | Radek | 49/115 |
| 4,641,460 | A * | 2/1987 | Kriegel | 49/115 |
| 4,702,037 | A * | 10/1987 | Hollowell et al. | 49/114 |
| 6,968,645 | B2 * | 11/2005 | Epps et al. | 49/123 |
| 2009/0000197 | A1 * | 1/2009 | Long | 49/107 |

* cited by examiner

*Primary Examiner* — Jerry Redman
(74) *Attorney, Agent, or Firm* — Symbus Law Group; Clifford D. Hyra

(57) ABSTRACT

A cantilevered folding gate (1) may be used with a module (13) which is suitable for fitting in such cantilevered folding gates (1) and includes a transmission mechanism (5) which is accommodated in a housing (14) and which is designed to transmit the movement of a first gate leaf (3) to a second leaf (4) so that the first (3) and second (4) gate leaf open or close simultaneously by folding.

16 Claims, 4 Drawing Sheets

CANTILEVERED FOLDING GATE AND MODULE SUITABLE FOR FITTING IN SUCH GATE

This application claims the benefit of Belgian patent application No. 2011/0160, filed Mar. 15, 2011, which is hereby incorporated by reference in its entirety.

FIELD OF THE INVENTION

The present invention on the one hand relates to a cantilevered folding gate. On the other hand, the present invention relates to a module which is suitable for fitting in such cantilevered folding gates and comprises a transmission mechanism which is accommodated in a housing and which is designed to transmit the movement of the first gate leaf to the second leaf so that the first and second gate leaf open or close simultaneously by folding.

The present invention relates in particular to a so-called 'speed' folding gate, in particular a gate which opens and closes quickly. Such folding gates are often used to control access of vehicles and are characterized by the fact that they open and close within a few seconds, as a result of which they offer a significantly higher security level than ordinary automatic gates or fences. Such folding gates are also considered to be a high-quality alternative to barriers which have the added advantage that they also prevent the free passage of pedestrians.

Such folding gates are generally opened and closed by an electric, pneumatic or hydraulic drive means. The drive means are fitted either in the upper or lower housing of the folding gate, or in its side columns.

BACKGROUND

Cantilevered folding gates are already known; European patent EP 1 595 050 B1 for example describes a number of embodiments of such folding gates. The described folding gates comprise: a column, a first gate leaf which is hingedly connected to the column, a second gate leaf which is hingedly connected to the first gate leaf, drive means designed to drive the first gate leaf and a transmission mechanism designed to transmit the movement of the first gate leaf to the second leaf so that the first and second gate leaf open or close simultaneously by folding. Furthermore, a projecting gearwheel is attached to the second gate leaf, whose axis of rotation is concentric with that of the hinge between the first and second gate leaf, in which the gearwheel remains statically arranged with respect to the second gate leaf and in which rotation of the gearwheel about its axis of rotation causes a rotation of the second gate leaf about said hinge.

According to a first embodiment, the transmission mechanism comprises an arm which is statically connected to the column and a rod, one end of which is hingedly connected to the arm and the other end of which is provided with a toothing which meshes with the abovementioned statically arranged gearwheel. When the first gate leaf is driven, the gate leaves will open or close simultaneously by folding.

However, this embodiment has the drawback that the opening or closing of the gate leaves by folding does not take place in a linear fashion, as a result of which the tip of the gate (end of the second gate leaf) makes a non-rectilinear movement when the gate opens or closes. In EP 1 595 050, this is solved by the second described embodiment in which the transmission mechanism now comprises a fixedly arranged chain wheel which is connected to the column and a transmission means in the form of a chain or belt between the fixedly arranged chain wheel and the statically arranged chain wheel at the position of the connection between the first and second gate leaf instead of the above-described mechanism of rods. In this embodiment, a guide wheel is provided on the end of the second gate leaf. However, this embodiment has the drawback that there is a risk that the chain will expand due to frequent use, as a result of which the orientation of the second leaf is no longer clearly determined by the movement of the first leaf. The second leaf can—within the limits of the expansion—assume any orientation, which disrupts the simultaneous movement of the two leaves.

An additional drawback of the embodiments shown in EP 1 595 050 is the fact that the transmission mechanism is fixedly connected to the column and is thus difficult to replace.

SUMMARY

It is now an object of the present invention to provide an alternative cantilevered gate which solves the imperfections of the described transmission mechanisms and makes it possible to replace the transmission mechanism in a simple and quick way.

The object of the invention is achieved by providing a cantilevered folding gate, comprising: a column, a first gate leaf which is hingedly connected to the column, a second gate leaf which is hingedly connected to the first gate leaf, drive means designed to drive the first gate leaf, a transmission mechanism designed to transmit the movement of the first gate leaf to the second leaf so that the first and second gate leaf open or close simultaneously by folding, in which said transmission mechanism is accommodated in a housing which is detachably connected to the first gate leaf, in which the transmission mechanism comprises a first rotatable element and a second rotatable element and furthermore comprises a first and second entrainment member which are respectively designed to connect the first rotatable element to the column and to connect the second rotatable element to the second gate leaf, that the column comprises a first retaining unit which is designed to accommodate the first entrainment member so that the first rotatable element, in use, cannot rotate with respect to the column, and that the second gate leaf comprises a second retaining unit which is designed to accommodate the second entrainment member so that the second rotatable element, in use, cannot rotate with respect to the second gate leaf. Such an embodiment has the significant advantage that the transmission mechanism can be readily replaced.

Preferably, the housing is made from plastic or metal. The housing is preferably detachably connected to the first gate leaf via, for example, a screw connection. Furthermore, the first and/or second retaining unit may be composed of one or more elements.

Preferably, a transmission means is provided between the first and second rotatable element. The transmission means may be in different forms, possible transmission means are: a chain, a rotating shaft with bevel gearwheels on both ends, gear rack, steel strip, steel wire, etc. . . .

In a preferred embodiment of the folding gate according to the invention, said first element is an element which is connected to the column and which is provided with a toothing along at least part of its outer periphery, and the second rotatable element which is connected to the second gate leaf is provided with a toothing along at least part of its outer periphery, in which the gate furthermore comprises a transmission means which is provided with a toothing at both its ends, with one end being designed to roll over the teeth of the first element and with the teeth of the other end meshing with the teeth of the second rotatable element. Such a folding gate has the advantage that opening or closing of the gate leaves by folding takes place linearly so that the tip of the gate (end of the second gate leaf) performs a rectilinear movement when the gate opens or closes. In addition, the transmission mechanism has the advantage that it does not expand. The way in which the transmission means rolls over the teeth of the respective elements, is also referred to as "rolling without sliding".

Due to the fact that the teeth of the transmission means mesh with both the first rotatable element and the second rotatable element, the second gate leaf will rotate about its connecting hinge with the first gate leaf when the first gate leaf is driven. As a result, the two gate leaves of the gate will open or close by folding, depending on how the first gate leaf is driven.

According to a preferred embodiment, the first gate leaf is connected to the column via a first set of hinges and the second gate leaf is connected to the first gate leaf via a second set of hinges.

In a particular embodiment of the cantilevered folding gate according to the invention, the distance between the axes of rotation of the first and second rotatable element (connected to the housing), respectively, is equal to the distance between the axes of rotation of the first set of hinges and the axes of rotation of the second set of hinges.

In a more particular embodiment of the cantilevered folding gate according to the invention, the housing is connected to the first gate leaf in such a manner that the axis of rotation of the first rotatable element coincides with the axis of rotation of the first set of hinges and that the axis of rotation of the second rotatable element coincides with the axis of rotation of the second set of hinges.

In a most particular embodiment of the cantilevered folding gate according to the invention, the first and second element is a gearwheel. A gearwheel is the most practical embodiment to achieve rolling without sliding. This guarantees the 'synchronization' of the movement.

According to a more particular embodiment of the folding gate according to the invention, the pitch diameter of the first element is twice as large as the pitch diameter of the second rotatable element. This results in the second gate leaf ending up parallel to the first gate leaf if the first gate leaf carries out a rotary movement of 90° between the closed position (both gate leaves are in line with one another) and the open position of the gate.

In an advantageous embodiment of the folding gate according to the invention, the transmission means is a gear rack. The transmission means may be designed as a single (long) gear rack. However, in an alternative embodiment, the transmission means may be designed as a gear rack consisting of two parts which are connected to one another along their longitudinal axis via a connecting rod. The meshing of the gear rack(s) with the gearwheels (in particular with the first and second (rotatable) element) is ensured by a support member which ensures that the teeth of the gearwheels and the teeth of the rack(s) stay connected. It is evident that other transmission solutions are also covered by the scope of protection and thus it is possible to opt for a transmission means which comprises a number of spaced-apart supporting rollers between which the teeth of the respective elements mesh instead of a gear rack.

Another object of the present invention relates to a module which is suitable for fitting in a cantilevered gate as described above according to the invention, in which said module comprises a transmission mechanism accommodated in a housing and is designed to transmit the movement of a first gate leaf to a second leaf so that a first and second gate leaf can open or close simultaneously by folding. Preferably, the transmission mechanism comprises a first rotatable element and a second rotatable element and furthermore comprises a first and second entrainment member which are respectively designed to connect the first element to the column and to connect the second rotatable element to the second gate leaf, that the column comprises a first retaining unit which is designed to accommodate the first entrainment member, so that the first rotatable element, in use, cannot rotate with respect to the column, and that the second gate leaf comprises a second retaining unit which is designed to accommodate the second entrainment member so that the second rotatable element, in use, cannot rotate with respect to the second gate leaf. Preferably, the first and/or the second element is a gearwheel.

The abovementioned module is designed to be connected to a first gate leaf of a cantilevered folding gate, preferably to a first gate leaf of a folding gate according to the present invention. The module according to the invention preferably has a substantially closed housing, as a result of which dirt and moisture cannot penetrate. Such a module also offers the option of integrating a heating element. This may be useful in extremely cold regions, so that, inter alia, the lubricant does not harden.

In a preferred embodiment of the module according to the invention, said transmission mechanism comprises a first and second entrainment member which are designed respectively for connecting the first element to a column and for connecting the second rotatable element to a second gate leaf. Due to the fact that the first entrainment member can be blocked (via a first retaining unit on the column), it is ensured that the first element cannot rotate with respect to the column (in other words, it remains statically arranged with respect to the column). Due to the fact that the second entrainment member can be blocked (via a second retaining unit on the second gate leaf), it is ensured that the second rotatable element cannot rotate with respect to the second gate leaf.

BRIEF DESCRIPTION OF THE DRAWINGS

The invention will now be explained in more detail by means of the following detailed description of, on the one hand, an embodiment of the cantilevered folding gate according to the present invention and, on the other hand, a module suitable for fitting in a cantilevered folding gate. This description only aims to give an illustrative example and can therefore by no means be interpreted as a limitation of the area of application of the invention or of the patent rights defined in the claims.

In this description, reference numerals are used to refer to the attached figures, in which.

DETAILED DESCRIPTION OF EMBODIMENTS

Figure 2:
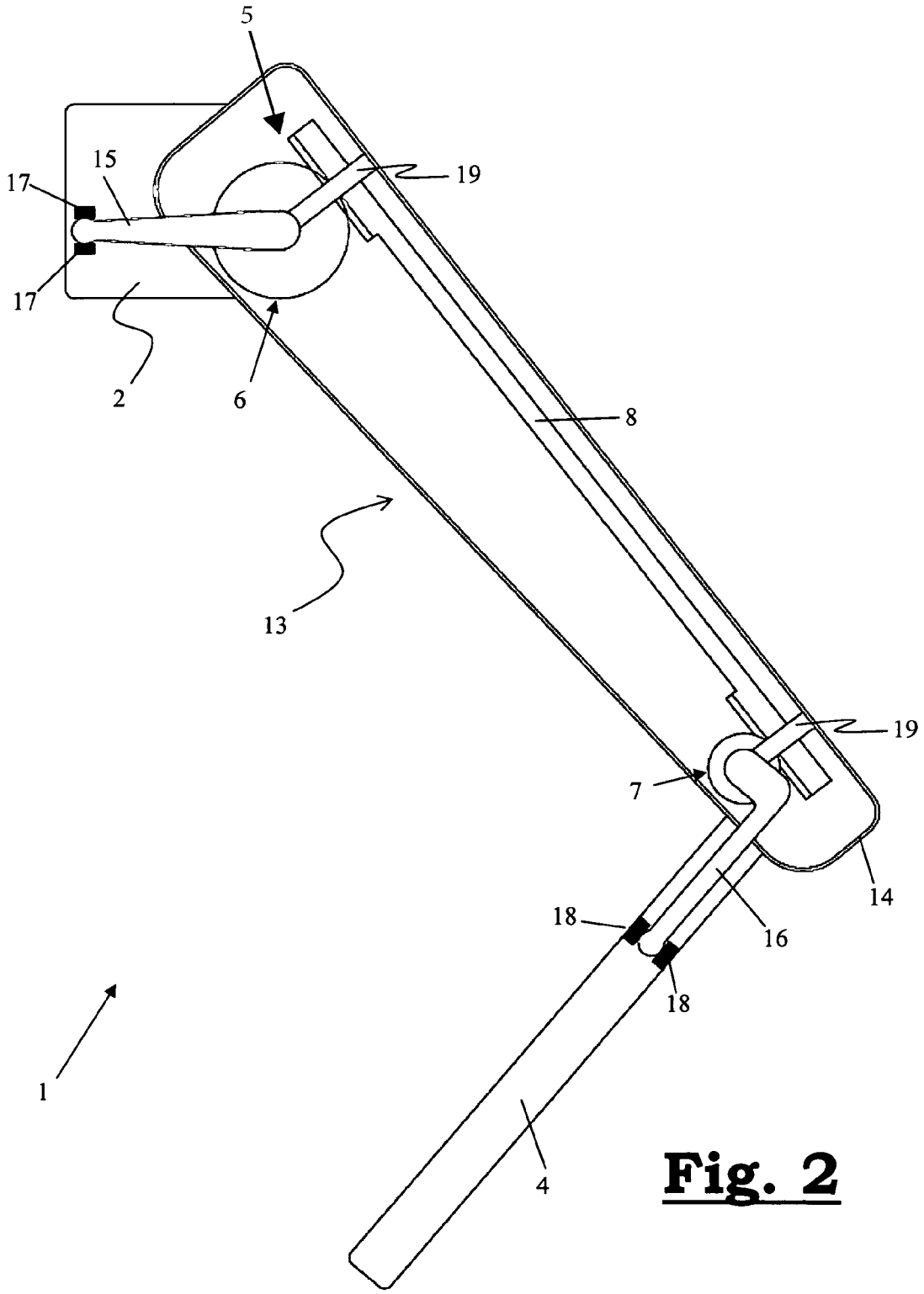
FIG. 2: shows a top view of the cantilevered folding gate according to the invention in which the module is fitted in the folding gate.
Figure 3:
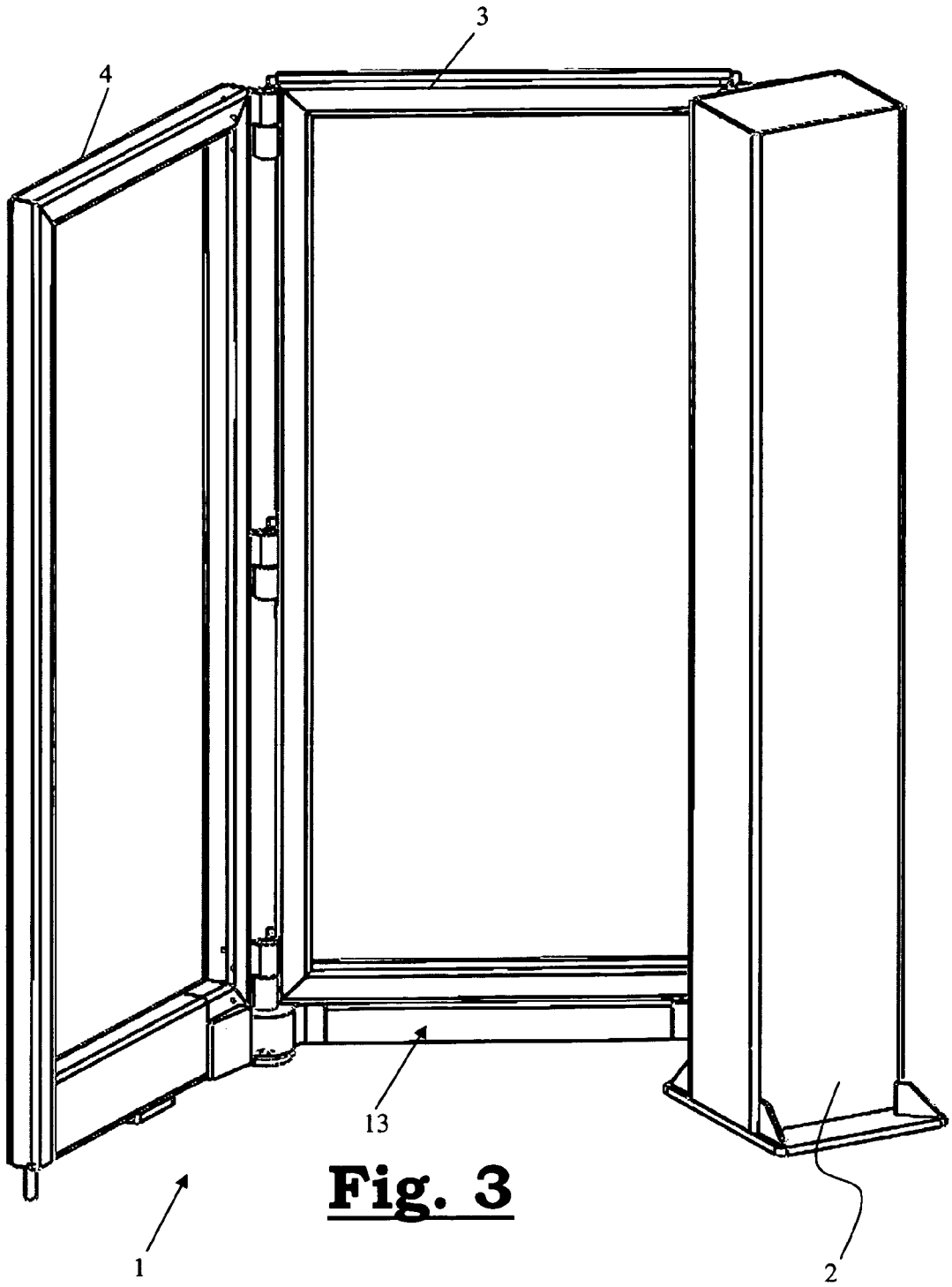
FIG. 3: shows a perspective view of the folding gate illustrated in FIG. 2.
Figure 4:
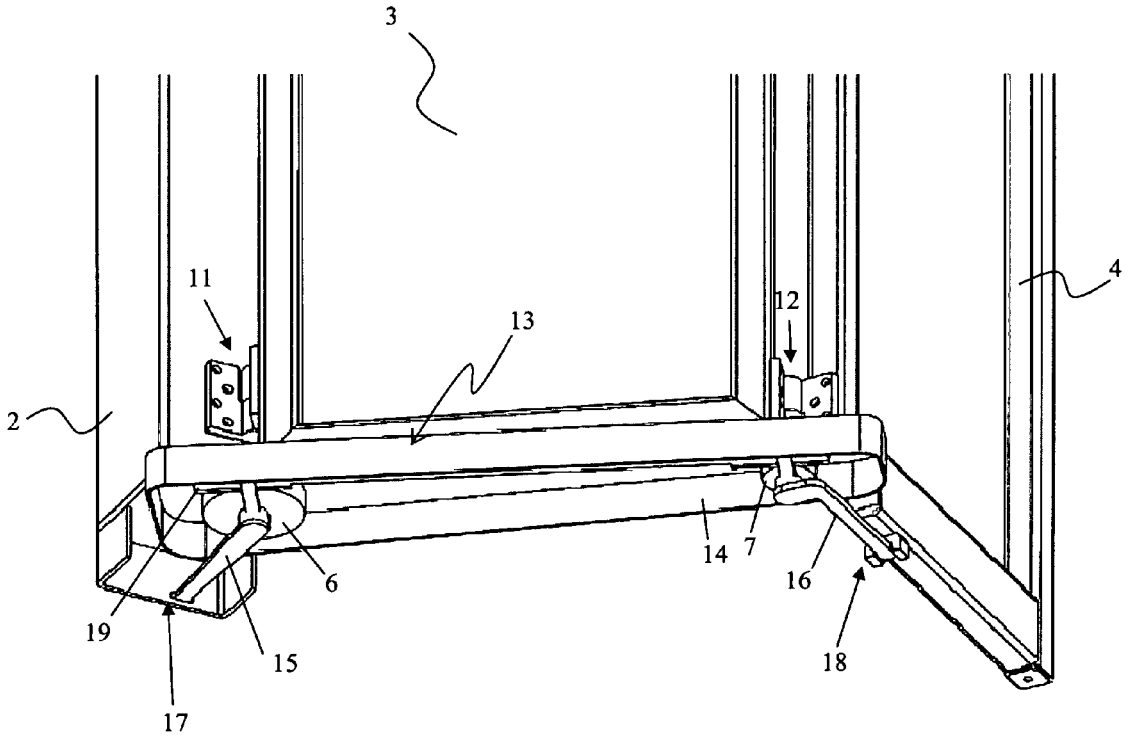
FIG. 4: shows a bottom view of a folding gate according to the invention with a fitted module, in which the connection between the module and the column, on the one hand, and the module and the second gate leaf on the other hand, is visible.

With the cantilevered folding gate (1) according to the present invention and as can also be seen in FIGS. 2, 3 and 4, a first gate leaf (3) of a double cantilevered folding gate is hingedly connected to a column (2). The connection is effected by means of a first set of hinges (11). A second gate leaf (4) is hingedly connected to this first gate leaf (3) via a second set (12) of hinges. Each gate leaf has virtually the same length and height.

The mechanical coupling between the two gate leaves is effected by means of a transmission mechanism (5) which is designed to transmit the movement of the first gate leaf (3) to the second leaf (4), so that the first (3) and second gate leaf (4) open or close simultaneously by folding. According to the present invention, said transmission mechanism (5) comprises a first fixedly arranged element (6) which is connected to the column (2) and which is provided with a toothing along at least part of its outer periphery and a second rotatable element (7) which is connected to the second gate leaf (4) is provided with a toothing along at least part of its outer periphery. The second rotatable element (7) is preferably a gearwheel and has a axis of rotation in common with the second set of hinges (12).

The transmission mechanism (5) according to the present invention furthermore comprises a transmission means (8) which, in a specific embodiment, is provided with a toothing at both its ends (9 and 10), with one end (9) being designed to roll over the teeth of the first element (6) and with the teeth of the other end (10) meshing with the teeth of the second rotatable element (7). The transmission means (8) which meshes with both the teeth of the first fixedly arranged element (6) and the teeth of the second rotatable element (7), ensures that the rotary movement of the first gate leaf (3), during opening of the gate (1), causes the second gate leaf (4) to rotate about its connecting hinges (12) (second set of hinges) with the first gate leaf (3), as a result of which the two leaves of the gate (1) open or close by folding, depending on how the first gate leaf (3) is driven. However, it is evident that other transmission means, such as for example a chain, rotating shaft, rod etc. are also covered by the scope of protection of the present invention.

The drive means for driving the first gate leaf (3) are fitted in the column (2) and comprise an electric, pneumatic or hydraulic drive means. However, the drive means may also form part of a separate unit which can be placed entirely or partly next to the column.

The first rotatable element (6) is preferably a gearwheel which has a common axis of rotation with the first set of hinges (11). The first rotatable element (6), in use, remains fixedly (statically) arranged with respect to the column (2) and will not execute a rotary movement about its axis, nor a translational movement. The first rotatable element (6) has a pitch diameter which is larger, preferably twice as large as the pitch diameter of the second rotatable element (7).

The transmission means (8) is designed to carry out a translational movement (relative to the first leaf) and is preferably designed as a single-part gear rack. However, the same effect can be achieved by a transmission means (8) which is made from two or more parts, such as for example two parts which are provided with a toothing at their surface and which are connected to one another along their longitudinal axis via a connecting rod.

The meshing of the transmission means (8) with the teeth of the first rotatable element (6) and the teeth of the second rotatable element (7), respectively, is ensured by a support member (denoted by reference numeral 19 on the attached figures) which ensures that the teeth of the transmission means (8), on the one hand, and the teeth of the first rotatable element (6) and the teeth of the second rotatable element (7), on the other hand, remain in contact with one another.

With the known folding gates, the various components of the mechanism (5) which ensures the mechanical coupling of the two gate leaves (3, 4) are connected to various parts of the folding gate (1). With such gates, the first rotatable element (6) and the second rotatable element (7) are fixedly connected to the column (2) and the second gate leaf (4), respectively. Such a construction has the drawback that, in case of repair, a technician has to disassemble parts in situ, at the very bottom of the gate or at the very top of the gate, reassemble them and readjust them, sometimes in adverse weather conditions, with the result that the gate is inoperative for a prolonged period of time.

In order to prevent this, the present invention provides a specific embodiment of the cantilevered folding gate (1) (see, inter alia, FIGS. 2 and 3). In this embodiment, the above-described transmission mechanism (5) is accommodated in a housing (14) and the transmission mechanism (5) furthermore comprises a first (15) and second (16) entrainment member which are respectively designed to connect the first rotatable element (6) to the column (2) and to connect the second rotatable element (7) to the second gate leaf (4). Preferably, the housing is made of plastic or metal. The housing (14) is preferably detachably connected to the first gate leaf (3), for example via a screw connection. As a result of the fact that the transmission mechanism (5) is accommodated in a housing (14) which is detachably connected to the gate (1), the transmission mechanism (5) can easily be replaced in case of problems with the transmission mechanism (5).

Now, in order to ensure that the first rotatable element (6), in use, cannot rotate with respect to the column (2), the column (2) comprises a first retaining unit (17) which is designed to accommodate the first entrainment member (15). The second gate leaf (4) also comprises a second retaining unit (18) which is designed to accommodate the second entrainment member (16), so that the second rotatable element (7), in use, cannot rotate with respect to the second gate leaf (4). In the illustrated figures, the first and second retaining unit (bracket) is in each case composed of a single-part element. However, it is evident that the same result can be achieved using two separate elements which are placed at a distance from one another and between which the entrainment members are locked. Said retaining units may, however, also be made from an elastomer material which may be of interest in certain cases from the point of view of assembly.

Figure 1:
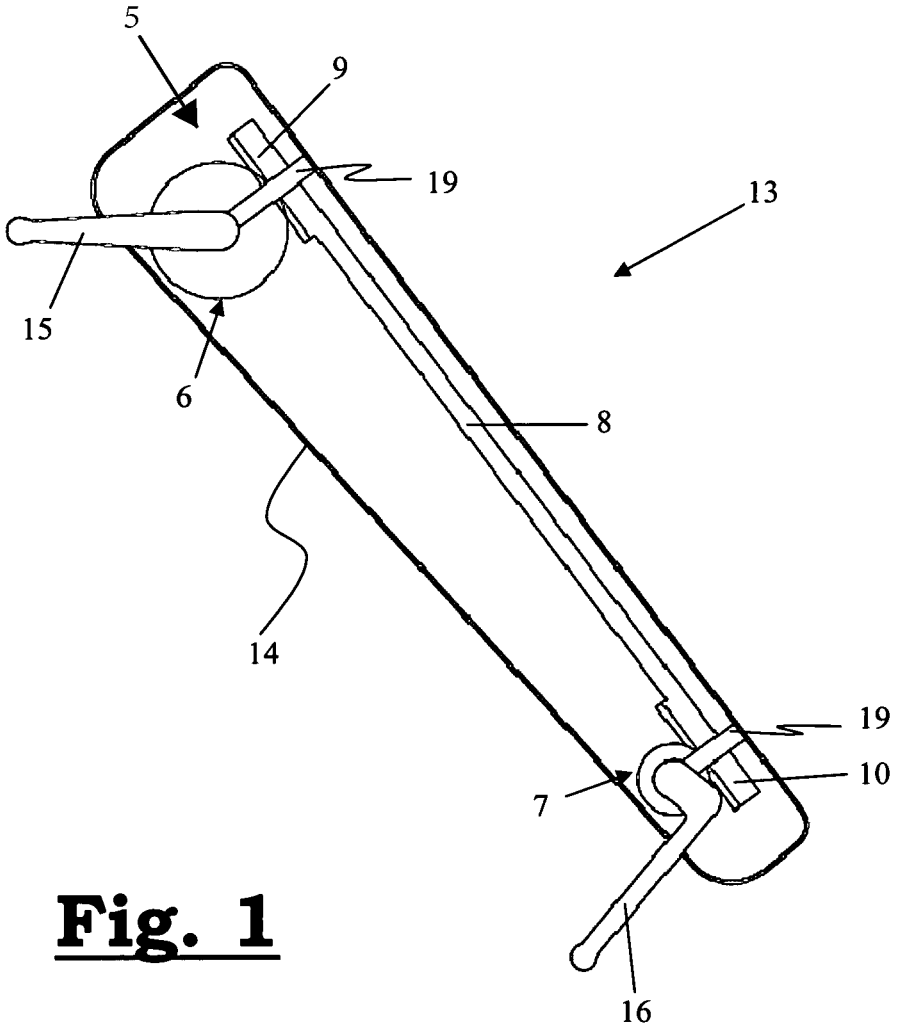
FIG. 1: shows the module according to the invention provided with the transmission mechanism.

The transmission mechanism (5) which is contained in the housing (14) is illustrated in FIG. 1 and forms a module (13) suitable for fitting in a cantilevered gate. Such a module (13) thus comprises a transmission mechanism (5) which is accommodated in a housing (14) and is designed to transmit the movement of a first gate leaf (3) to a second gate leaf (4) so that a first (3) and second (4) gate leaf can open or close simultaneously by folding. The transmission mechanism (5) which is provided in the housing (14) furthermore comprises a first element (6) which can be connected to a column (2) and, in use, cannot rotate with respect to the column (2) and which is provided with a toothing along at least part of its outer periphery, a second rotatable element (7) which can be connected to a second gate leaf (4) and which is provided with a toothing along at least part of its outer periphery, and furthermore a transmission means (8) which is provided with a toothing at its both ends (9, 10), with one end (9) being designed to roll over the teeth of the first element (6) and with the teeth of the other end (10) meshing with the teeth of the second rotatable element (7). Preferably, both said first and second elements will be gearwheels.

The first rotatable element (6) is mounted in bearings in the housing (14) and can only rotate about the axis of rotation of this bearing. The second rotatable element (7) is also mounted in bearings in the housing (14) and can only rotate about the axis of rotation of this bearing. The transmission means (8) meshes with both the teeth of the first element (6) and the teeth of the second rotatable element (7), and thus ensures that the rotary movement of both said elements (6 and 7) is synchronized. The transmission means can only execute a translational movement with respect to the housing.

Such a module (13) offers the significant advantage that it can be produced separately from the folding gate (1) and can subsequently be attached to the gate without any problems (see for example FIG. 3). As a result thereof, it is readily possible, for example if the gate is inoperative due to a problem with the transmission mechanism, to remove the module (13) which is present from the first gate leaf of the gate (1) and then to fit a replacement module according to the invention.

The invention claimed is:

1. Cantilevered folding gate, comprising:

a column;

a first gate leaf which is hingedly connected to the column;

a second gate leaf which is hingedly connected to the first gate leaf;

drive mechanism designed to drive the first gate leaf;

a transmission mechanism designed to transmit movement of the first gate leaf to the second leaf so that the first and second gate leaf open or close simultaneously by folding, wherein said transmission mechanism is substantially accommodated in a housing which is detachably connected to the first gate leaf, wherein the transmission mechanism comprises a first rotatable element and a second rotatable element between which a transmission element is provided and furthermore comprises first and second entrainment members which are respectively designed to connect the first rotatable element to the column and to connect the second rotatable element to the second gate leaf, wherein the column comprises a first retaining unit which is designed to accommodate an end of the first entrainment member so that the first rotatable element, in use, cannot rotate with respect to the column, wherein the second gate leaf comprises a second retaining unit which is designed to accommodate an end of the second entrainment member so that the second rotatable element, in use, cannot rotate with respect to the second gate leaf, wherein said first element is an element which is connected to the column and which is provided with a toothing along at least part of its outer periphery, and wherein the second rotatable element which is connected to the second gate leaf is provided with a toothing along at least part of its outer periphery, wherein the transmission element is provided with a toothing at both its ends, with one end being designed to roll over the teeth of the first rotatable element and with the teeth of the other end meshing with the teeth of the second rotatable element.

2. Cantilevered folding gate according to claim 1, characterized in that the first gate leaf is connected to the column via a first set of hinges, and in that the second gate leaf is connected to the first gate leaf via a second set of hinges.

3. Cantilevered folding gate according to claim 2, characterized in that the distance between the axes of rotation of the first and second rotatable element, respectively, is equal to the distance between the axes of rotation of the first set of hinges and the axes of rotation of the second set of hinges.

4. Cantilevered folding gate according to claim 2, characterized in that the housing is connected to the first gate leaf in such a manner that the axis of rotation of the first rotatable element coincides with the axis of rotation of the first set of hinges and that the axis of rotation of the second rotatable element coincides with the axis of rotation of the second set of hinges.

5. Cantilevered folding gate according to claim 1, characterized in that the first and second elements are gearwheels.

6. Cantilevered folding gate according to claim 1, characterized in that a pitch diameter of the first element is twice as large as a pitch diameter of the second rotatable element.

7. Cantilevered folding gate, comprising:

a column;

a first gate leaf which is hingedly connected to the column;

a second gate leaf which is hingedly connected to the first gate leaf;

drive mechanism designed to drive the first gate leaf;

a transmission mechanism designed to transmit movement of the first gate leaf to the second leaf so that the first and second gate leaf open or close simultaneously by folding, wherein said transmission mechanism is substantially accommodated in a housing which is detachably connected to the first gate leaf, wherein the transmission mechanism comprises a first rotatable element and a second rotatable element between which a transmission element is provided and furthermore comprises first and second entrainment members which are respectively designed to connect the first rotatable element to the column and to connect the second rotatable element to the second gate leaf, wherein the column comprises a first retaining unit which is designed to accommodate an end of the first entrainment member so that the first rotatable element, in use, cannot rotate with respect to the column, wherein the second gate leaf comprises a second retaining unit which is designed to accommodate an end of the second entrainment member so that the second rotatable element, in use, cannot rotate with respect to the second gate leaf, and wherein the transmission element is a gear rack.

8. Cantilevered folding gate according to claim 7, characterized in that the first gate leaf is connected to the column via a first set of hinges, and in that the second gate leaf is connected to the first gate leaf via a second set of hinges.

9. Cantilevered folding gate according to claim 8, characterized in that the distance between the axes of rotation of the first and second rotatable element, respectively, is equal to the distance between the axes of rotation of the first set of hinges and the axes of rotation of the second set of hinges.

10. Cantilevered folding gate according to claim 8, characterized in that the housing is connected to the first gate leaf in such a manner that the axis of rotation of the first rotatable element coincides with the axis of rotation of the first set of hinges and that the axis of rotation of the second rotatable element coincides with the axis of rotation of the second set of hinges.

11. Cantilevered folding gate according to claim 7, characterized in that the first and second elements are gearwheels.

12. Cantilevered folding gate according to claim 7, characterized in that a pitch diameter of the first element is twice as large as a pitch diameter of the second rotatable element.

13. A module configured to detachably connect to a cantilevered folding gate, comprising a transmission mechanism which is accommodated in a housing and is designed to transmit movement of a first gate leaf to a second leaf so that a first and second gate leaf can open or close simultaneously by folding, wherein the transmission mechanism comprises a first rotatable element and a second rotatable element between which a transmission element is provided and furthermore comprises first and second entrainment members which are respectively designed to connect the first rotatable element to a column of the cantilevered folding gate and to connect the second rotatable element to the second gate leaf, wherein said first rotatable element is provided with a toothing along at least part of its outer periphery, and wherein the second rotatable element is provided with a toothing along at least part of its outer periphery, wherein the transmission element is provided with a toothing at both its ends, with one end being designed to roll over the teeth of the first rotatable element and with the teeth of the other end meshing with the teeth of the second rotatable element, said cantilevered folding gate comprising:

a column;

the first gate leaf which is hingedly connected to the column;

the second gate leaf which is hingedly connected to the first gate leaf;

drive mechanism designed to drive the first gate leaf;

a space on the first gate leaf for connection of the module for transmission of the movement of the first gate leaf to the second leaf so that the first and second gate leaf open or close simultaneously by folding, wherein the column comprises a first retaining unit which is designed to accommodate an end of the first entrainment member so that the first rotatable element, in use, cannot rotate with respect to the column, wherein the second gate leaf comprises a second retaining unit which is designed to accommodate an end of the second entrainment member so that the second rotatable element, in use, cannot rotate with respect to the second gate leaf.

14. Module according to claim 13, characterized in that the housing is made of plastic or metal.

15. Module according to claim 13, characterized in that the housing can be connected to the first gate leaf via a screw connection.

16. Module according to claim 13, characterized in that said module furthermore comprises a heating element.

* * * * *